US011331560B2

(12) United States Patent
Heim

(10) Patent No.: US 11,331,560 B2
(45) Date of Patent: May 17, 2022

(54) POLE HANDLE

(71) Applicant: Lekisport AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 16/960,808

(22) PCT Filed: Jan. 18, 2019

(86) PCT No.: PCT/EP2019/051209
§ 371 (c)(1),
(2) Date: Jul. 8, 2020

(87) PCT Pub. No.: WO2019/149544
PCT Pub. Date: Aug. 8, 2019

(65) Prior Publication Data

US 2020/0352290 A1 Nov. 12, 2020

(30) Foreign Application Priority Data

Feb. 1, 2018 (CH) ..... CH00113/18

(51) Int. Cl.
*A63C 11/22* (2006.01)
*A45B 9/02* (2006.01)

(52) U.S. Cl.
CPC ..... *A63C 11/2224* (2020.08); *A45B 9/02* (2013.01); *A45B 2009/025* (2013.01); *A45B 2200/05* (2013.01); *A45B 2200/055* (2013.01)

(58) Field of Classification Search
CPC ..... A63C 11/2224; A63C 11/222
See application file for complete search history.

(56) References Cited

U.S. PATENT DOCUMENTS 3,982,747 A * 9/1976 Schweinsberg ..... A63C 11/222 280/822
5,110,154 A 5/1992 Street
(Continued)

FOREIGN PATENT DOCUMENTS

EP 2 745 888 A1 6/2014
WO 2006/066423 A1 6/2006
(Continued)

OTHER PUBLICATIONS

International Search Report for PCT/EP2019/051209 dated Apr. 8, 2019 [PCT/ISA/210].
(Continued)

*Primary Examiner* — Noah Chandler Hawk
(74) *Attorney, Agent, or Firm* — Sughrue Mion, PLLC

(57) ABSTRACT

A pole handle (1), for walking sticks and the like, having a handle body (3) and a hook-like device (14) for fastening a hand strap or of a glove. A displaceable latch-in structure (7) is arranged in the region of the hook-like device (14) such that a eyelet-form device (42), which is provided on the hand strap or glove and is pushed into the hook-like device (14) essentially from above, is fixed in the hook-like device (14) with self-latching action. The pole handle (1) does not have any structure that can displace or free the latch-in structure (7), such that an eyelet-form device (42) pushed into the hook-like device (14) can be removed from a confined region (15) in a force-free manner or counter to a relatively low force, the hand strap or glove being separated from the pole handle (1) in the process.

27 Claims, 3 Drawing Sheets

(56) References Cited

U.S. PATENT DOCUMENTS

| | | | | |
|---|---|---|---|---|
| 5,516,150 | A | 5/1996 | Goode et al. | |
| 6,325,418 | B1 * | 12/2001 | Lenhart | A63C 11/222 280/821 |
| 7,226,084 | B2 * | 6/2007 | Lenhart | A63C 11/222 280/822 |
| 9,526,974 | B2 * | 12/2016 | Bennert | A63C 11/227 |
| 10,064,463 | B2 * | 9/2018 | Kreis | A63C 11/227 |
| 2014/0165336 | A1 * | 6/2014 | Guyoton | A45B 9/02 16/430 |
| 2017/0231339 | A1 * | 8/2017 | Kreis | A45B 9/02 135/76 |
| 2018/0271236 | A1 * | 9/2018 | Heim | A45B 9/02 |

FOREIGN PATENT DOCUMENTS

| | | | |
|---|---|---|---|
| WO | 2006/066424 | A1 | 6/2006 |
| WO | 2007/090310 | A1 | 8/2007 |
| WO | 2016/037940 | A1 | 3/2016 |

OTHER PUBLICATIONS

Written Opinion for PCT/EP2019/051209 dated Apr. 8, 2019 [PCT/ISA/237].

* cited by examiner

POLE HANDLE

CROSS REFERENCE TO RELATED APPLICATIONS

This application is a National Stage of International Application No. PCT/EP2019/051209 filed Jan. 18, 2019, claiming priority based on Swiss Patent Application No. 00113/18 filed Feb. 1, 2018.

TECHNICAL FIELD

The present invention relates to a pole handle, in particular for walking sticks, trekking poles, (cross-country) ski poles and Nordic walking poles. The pole handle has a handle body with a hook-like device for fastening a hand-retaining device in particular in the form of a hand strap or of a glove. The present invention also relates to a pole having such a pole handle and to a method for assembly of such a pole handle.

PRIOR ART

In the case of such a device known, for example, from U.S. Pat. No. 5,516,150, a hook is provided on the pole handle and a rigid bracket-like device formed from a stiff metal bar is provided on the associated glove, in the region between thumb and forefinger. The long straight leg of the bracket is introduced into a narrow slot of the hook, and the hook-like device fixes the bracket, and therefore the glove, on the pole handle.

The slot is widened slightly at the bottom of the hook, which means that, when it is being inserted into the hook, the bracket first of all pushes the two legs of the hook slightly apart from one another (material deformation), and that it is only when the bracket has been pushed into the widened portion that the legs resume their original position.

An elastic deformation of the hook-like device is therefore used to ensure easy fixing of the bracket in the hook, and to avoid the situation where the bracket simply slips out of the hook.

The problem with such devices is, inter alia, the fact that repeated deformations of such components, which are usually formed from plastic or metal, are undesirable on account of signs of fatigue being manifested.

Furthermore, there is, in particular, the problem of the elastic deformation behavior of materials being highly temperature-dependent. It is therefore also the case that the fixing action obtained by the deformation is neither capable of being set, nor constant, for different temperatures. Release cannot be defined in any clear-cut manner, and it is generally the case that the release values can be reproduced only with great difficulty, if at all.

This is unacceptable in particular in sports, since very large temperature differences are unavoidable, on the one hand, as a result of different weather conditions and, on the other hand, as a result of heating up occurring during use.

U.S. Pat. No. 5,110,154 discloses a pole handle in which the connection between the pole handle and a hand-retaining device is established by virtue of it being possible for a stiff ring or bracket, which is fastened on the hand-retaining device, to be pushed into an aperture in the form of a horizontal slot arranged in that surface of the handle which is directed toward the hand-retaining device. Said slot is arranged perpendicularly to the axis of the handle and, to provide for good fastening, has to be narrow; it is a correspondingly laborious task to introduce the hand-retaining device, or the stiff bracket fastened thereon, in said slot in order to be fastened on the pole handle. For this purpose, the bracket has to be positioned precisely relative to the slot, which, in reality, is impractical.

WO2006/066423 discloses a pole handle, in particular for walking sticks, trekking poles, (cross-country) ski poles and Nordic walking poles, having a handle body and having a hook-like device for fastening a hand-retaining device in particular in the form of a hand strap or of a glove. Latch-in means are arranged in the region of the hook-like device such that a loop-form, ring-form or eyelet-form device, which is provided on the hand-retaining device and is pushed from above into the hook-like device, is fixed in the hook-like device with self-latching action. For the purpose of removing the loop-form, ring-form or eyelet-form device from the hook-like device, the handle head has a pushbutton, which can be used to displace or rotate the latch-in means such that they free the previously enclosed region and the device can be removed again in the upward direction. This self-latching mechanism with a release mechanism facilitates handling, but is relatively complex and is not suitable for all target groups.

WO2007/090310 discloses a similar pole handle, although in this case the device for self-latching fastening purposes comprises at least one aperture for accommodating a coupling element, in particular preferably in the form of a bracket or of a loop, provided on the hand-retaining device, wherein the device has a clamping element and, in an introduction position of the clamping element, the aperture of the device is exposed such that the coupling element of a hand-retaining device not connected to the pole handle can be introduced into said aperture, and wherein tilting of the clamping element can move the device into a locking position, in which the aperture is closed and the coupling element is arrested in the aperture.

EP-A-2745888 describes a handle having a hand strap which comprises a strap connected to an insert. A body of the handle is oriented along a longitudinal axis. An insert housing is arranged in an upper end of the body, and therefore the insert is inserted into the housing along a direction parallel to the axis. A locking mechanism retains the insert in the housing, unlocking of the mechanism being actuated directly by virtue of the insert being displaced in a direction counter to an introduction direction of the insert. The locking mechanism comprises a locking means, which can be moved in relation to the body.

DESCRIPTION OF THE INVENTION

Accordingly, it is an object of the present invention to provide a simplified and nevertheless stable and reliable pole-handle design in which a hand-retaining device with a coupling element in the form of a bracket or of a loop can be fastened on the pole handle with self-latching action and, if required, can also easily be released again from said fastening.

The object of this invention is achieved by a pole handle having the features of claim 1.

Accordingly, the present invention relates to a pole handle, e.g. for walking sticks, trekking poles, (cross-country) ski poles and Nordic walking poles, having a handle body and having a hook-like device for fastening a hand-retaining device, in particular in the form of a hand strap or of a glove. Displaceable latching means (rather than these being devices with rotatable latching means, they are latching means which can be displaced along an axis, without any rotation, wherein the latching means is that component which itself restrains the pushed-in loop-form, ring-form or eyelet-form device) are arranged in the region of the hook-like device such that a loop-form, ring-form or eyelet-form device (e.g. one according to WO 2006/066424), which is provided on the hand-retaining device and is pushed into the hook-like device essentially from above, is fixed in the hook-like device in a self-latching manner.

These are expressly displaceably mounted latching means, and not designs in which the latch-in action is ensured by material deformation or rotation, for example as is the case in U.S. Pat. No. 5,516,150, which was mentioned in the introduction. This is because such designs, as likewise already mentioned, have the great disadvantage that the corresponding material deformation is highly temperature-dependent and accordingly, in particular at low temperatures, the removal force is too great, or too low at high temperatures, and action is impaired by fatigue or material aging and stiffening.

In the case of the pole handle proposed here, the hook-like device is arranged in the upper region of the pole handle, on the hand side, and comprises a retaining protuberance or retaining pin, which is offset from the handle body in the direction of the hand side, an upwardly open introduction slot being formed in the process, or is arranged in the form of an incision in the handle body.

The latch-in means are designed in the form of a restraining nose, which, in the braced position, defines in the downward direction a region for the loop-form, ring-form or eyelet-form device, said region being confined counter to a force.

The proposed pole handle, then, is in particular characterized in that, in contrast for example to the designs as are known from WO2006/066423 or WO2007/090310, it has precisely no means which allow the latch-in means to be actively displaced or otherwise freed by the user such that a loop-form, ring-form or eyelet-form device pushed into the hook-like device can be removed from the confined region in a force-free manner or counter to a considerably lower force, the hand-retaining device being separated from the pole handle in the process.

Surprisingly, it has been found that, if the latch-in means are mounted in the form of displaceable elements, rather than rotatable or tiltable elements, in the pole handle, the inherently very sound, but also relatively complex, design as is known from WO2006/066423 or WO2007/090310 can be rendered sufficient, and still expedient, for many applications, if the release mechanism according to WO2006/066423 or WO2007/090310 is dispensed with. In particular, a design like that proposed here, surprisingly, is still adequate at low temperatures or very high temperatures, this latter not being expected.

In contrast to the design as is known from WO2006/066423 or WO2007/090310, the hand-retaining device of the design proposed here is released from its fastening on the pole handle by virtue of the hand-retaining device being pulled specifically upward until the latch-in means frees the loop again as a result of temporary displaceable of the latch-in means. Although this functionality is likewise provided in the form of a safety release in certain embodiments of the design as is known from WO2006/066423 or WO2007/090310, it is always provided there in combination with a separate release mechanism, i.e. a button, lever or the like, which is provided on the (head of the) pole handle and displaces or rotates the latch-in means, to some extent, out of the introduction slot, in which case the loop can then be removed from the slot essentially in a force-free manner.

In addition, the force required for the safety release in these designs according to WO2006/066423 or WO2007/090310 is considerably greater than the force which is set in respect of the mounting of the latch-in means provided here. In specific terms, it is typically the case within the context of the present invention to set a force ranging from 60-100N, preferably ranging from 70-90N, for the purpose of removing the hand strap (essentially parallel to the introduction direction of the loop).

A first preferred embodiment of the present invention is characterized in that the latch-in means are designed in the form of a locking pin which can be displaced along a displacement direction counter to a restoring force, wherein the locking pin is braced against the retaining protuberance and/or against an inner stop in the handle body, and a front region of the locking pin projects into the introduction slot, or the incision, behind the retaining protuberance and delimits the confined region for the loop-form, ring-form or eyelet-form device in the upward direction, and a rear region in the handle body is mounted in a displaceable manner in an aperture.

The restoring force can be ensured, for example, by a spring, in particular in the form of a helical spring, provided in the aperture, wherein for example the helical spring engages at least to some extent around an end portion of the locking pin which is directed toward the pole handle.

The pole handle extends preferably along a pole axis, and the introduction slot, or incision, behind the retaining protuberance defines an introduction direction, which runs essentially parallel to the pole axis. According to a quite particularly preferred embodiment, then, a displacement direction of the locking pin in the direction of the retaining protuberance encloses an angle $\varphi$ of less than 90° with the upwardly directed pole-axis direction.

It is precisely as a result of this arrangement, then, that, although on the one hand sufficient fixing of the loop or eyelet against unintended release from the pole handle is ensured, it also being possible for said loop or eyelet to be readily introduced from above, on the other hand sufficiently easy removal is also possible. In fact, it is particularly easy to arrange things, for example in design terms such that, as likewise according to a preferred embodiment, the force which is necessary for introducing the loop-form, ring-form or eyelet-form device behind, or beneath, the locking pin is smaller than the force which is necessary for removing the loop-form, ring-form or eyelet-form device.

This is important and advantageous because it should be easier for the user to fasten the hand strap on the pole handle; in addition, the latch-in force can be more easily applied since it corresponds to the usual loading of the hand strap on the pole handle. In contrast, it should not be possible for the hand strap to be released unintentionally from the handle; the removal force should therefore be greater than the introduction force. Typically, the introduction force for latching the loop in behind the retaining protuberance ranges from 50-70N, preferably ranges from 55-65N, and the release force ranges from 70-90N, preferably ranges from 75-85N. The forces here are regarded as being measured parallel to the introduction direction, i.e. essentially parallel to the pole axis. The angle $\varphi$ here preferably ranges from 60-85°, in particular preferably ranges from 70-80° or ranges from 72-77°. Angles in the region of 75° are ideal. According to a further preferred embodiment, the tip of the locking pin, said tip being directed toward the retaining protuberance, has a dome-shaped or hemispherical rounding, which, in particular at different temperatures, further facilitates introduction and removal, in particular with the angle being set, at the same time, as specified above.

As an alternative, it is possible for the relationships of the forces to be the other way round, i.e. for the force which is necessary for introducing the loop-form, ring-form or eyelet-form device behind, or beneath, the locking pin to be greater than the force which is necessary for removing the loop-form, ring-form or eyelet-form device. This being the case, for example, with a displacement direction of the locking pin in the direction of the retaining protuberance enclosing an angle φ of greater than 90°, preferably ranging from 95-120°, in particular preferably ranging from 100-110° or ranging from 102-107°, with the upwardly directed pole-axis direction.

It is possible for the tip of the locking pin, in the rest state, to be in contact with the retaining protuberance or to be spaced apart from the retaining protuberance by no more than 1 mm, preferably no more than 0.5 mm or 0.2 mm. A slight distance of this order combined with the hemispherical rounding and the aforementioned angle can provide for a particularly good design.

The locking pin consists preferably of metal or a for example glass-fiber-reinforced high-strength plastic, in particular polyamide or polypropylene. The handle body preferably of a thermoplastic material, for example polypropylene, it also being possible for the handle body, in certain handle regions, to have coatings or inserts made of other materials, for example softer plastic materials (for example elastomeric materials) or cork coatings.

The locking pin is mounted in a displaceable manner, in particular preferably in the form of a cylindrical (metal) pin, in the handle body such that, in the region adjacent to the introduction slot, or incision, the front region is guided to some extent in a cylindrical guide aperture, which widens in the direction of the interior of the handle body, a step being formed in relation to the aforementioned aperture in the process.

Adjacent to the front region on the inside, the locking pin can have an encircling collar, of which the outer radius essentially corresponds to the inner radius of the aforementioned aperture or is smaller than same, but greater than the radius of the guide aperture.

The rear region of the locking pin preferably follows said collar in the direction of the interior of the handle body and has a smaller outer radius than the collar, preferably the same outer radius as, or a somewhat smaller outer radius than, the front region of the locking pin.

A helical spring can then surround said rear region and butt against the collar. The helical spring can also be replaced by a hollow-cylinder elastomer spring or by an elastomer spring in general, which is then arranged for example between a closure peg and the inner end of the locking pin. In this case, the rear end of the locking pin can then be cylindrical, without any offset or step formation behind the collar.

Preferably at least in the front region, preferably in the front region and in the rear region, the locking pin has a diameter ranging from 1-8 mm, preferably ranging from 2-6 mm, in particular ranging from 3-5 mm. A further preferred, as it were modular embodiment is characterized in that a separate fastening block with the retaining protuberance, locking pin and guide for the locking pin, is fastened in an immovable manner in an aperture of the handle body, which aperture is configured preferably in the form of an aperture which runs in the direction of travel, and therefore the head region is formed laterally by the handle body. Said fastening block is fastened in the handle body preferably via at least one, or preferably two, transverse pin(s).

The fastening block can have a through-passage opening for the locking pin, said through-passage opening being closed on the rear side of the fastening block via a closure peg, preferably made of metal or plastic. The closure peg can be inserted by adhesive bonding, pressing action, screwing action or clicking action, or a combination thereof. The fastening block can have a guide cylinder for the locking pin and also at least one through-hole (as a weight-saving measure) running transversely to the direction of travel.

A further preferred embodiment is characterized in that the fastening block has two through-passage openings, or depressions designed on either side in each case in the form of a blind hole, running transversely to the pole axis, and is fastened in the aperture in the handle body using corresponding transverse pins, wherein at least one of the transverse pins, preferably the transverse pin arranged further upward in the direction of the handle head, serves, in addition, to fasten a covering cap, which delimits the handle head at least to some extent in the upward direction, preferably the covering cap having downwardly directed fastening arms with through-passage openings for the corresponding transverse pin.

At least in the outwardly exposed region, said covering cap, which has a convex surface forming the upper surface of the handle head, can be provided with a non-slip and/or soft (plastic) coating (for example forming a two-part component) or can consist of a corresponding non-slip and/or soft material.

The pole handle preferably has a lower handle-body region, the latter forming a lower gripping region of the pole handle and having an aperture for a pole shaft at the lower end, and also has a head region. The head region preferably has a widened portion at the front, said widened portion merging essentially smoothly, in the front pole-handle region, into the upper gripping region.

Preferably in the front pole-handle region, the widened portion is formed with an overhang, which projects beyond the gripping region as seen in the direction of travel. The overhang here is preferably more than 50% of an average extent of the gripping region in the direction of travel. Further preferably, a section plane of the head region which is defined by a foremost tip of the widened portion and by a transverse axis of the head region which is arranged transversely to the longitudinal axis of the pole and transversely to the direction of travel and is arranged where the head region is widest, as measured transversely to the direction of travel and transversely to the longitudinal axis of the pole, is angled from the longitudinal axis of the pole preferably at an obtuse angle ranging from 90-135 degrees.

In said section plane, the head region has preferably a rounded contour. The front portion of said contour, as seen in the direction of travel, is defined preferably essentially by an arc of a first circle and a rear portion of said contour, as seen counter to the direction of travel, is defined essentially by an arc of a second circle. The center points of said first and second circles are offset in relation to one another by an amount of 0.5-6 cm preferably along the direction of travel, wherein the radius of curvature of the first circle is smaller than the radius of curvature of the second circle in the rear pole-handle region.

The present invention also relates to a pole, in particular a walking stick, trekking pole, (cross-country) ski pole or Nordic walking pole, having a pole handle, as set out above, having a pole shaft, which is preferably in one piece or, for adjustment in accordance with requirements, in more than one piece (with outer and/or inner clamping of the shaft portions), and having a pole tip. This is all provided alone or in combination with a hand-retaining device in particular in the form of a hand strap or of a glove, on which a loop-form, ring-form or eyelet-form device is provided (e.g. one according to WO 2006/066424). In combination with the pole handle proposed here, use is preferably made of a hand strap comprising an introduction opening for the hand, a first exit opening for the back of the hand and a second exit opening for the thumb, wherein the hand-retaining device also has a first strip, which is guided between the thumb and the other fingers and on which is provided a coupling element, which can be fastened in or on the pole handle with self-latching action in a releasable mechanism, wherein the hand strap is characterized in that the first strip is of elastic design at least in some regions on that side of the coupling element which faces the outer surface of the hand. Such a hand strap is known, for example, from WO 2016/037940, and the disclosure content thereof relating to the hand strap is expressly included herein.

Finally, the present invention relates to a method for assembling a pole handle as set out above, the method being characterized, in particular in that the locking pin is pushed into the fastening block, from the rear side of the latter, into the aperture and in particular into the guide aperture, a helical spring is pushed in and the aperture is closed on the rear side by a closure peg, then the fastening block is inserted into the aperture in the handle body of the pole handle, then, if present, the covering cap is inserted, essentially closing off the definitive surface of the handle head, and is preferably latched in the front-tip region, and then transverse pins are used to fasten the fastening block and covering cap, provided that one of the transverse pins for fastening the fastening block can also be used just for fitting the covering cap.

Further embodiments are specified in the dependent claims.

BRIEF DESCRIPTION OF THE DRAWINGS

Preferred embodiments of the invention will be described hereinbelow with reference to the drawings, which serve merely for explanatory purposes and should not be interpreted as being restrictive. In the drawings.

DESCRIPTION OF PREFERRED EMBODIMENTS

Figure 1:
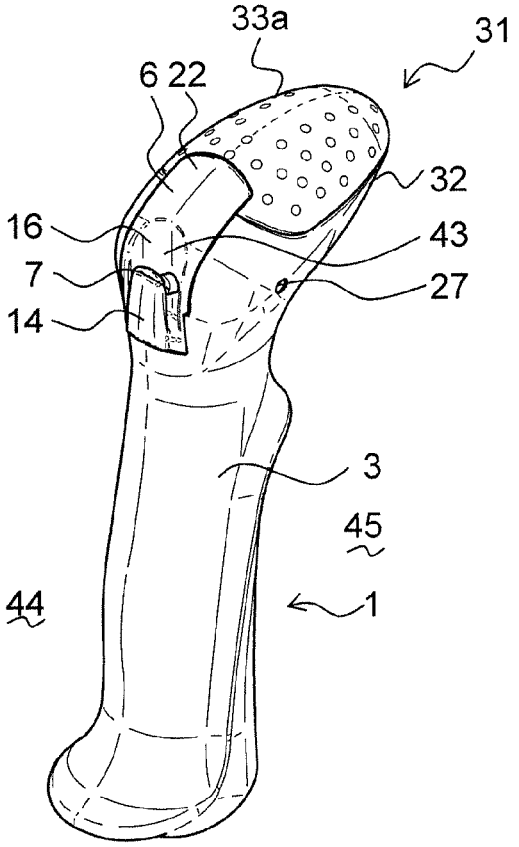
FIG. 1 shows a perspective view of a pole handle as seen obliquely from the rear and from above (hand side)
Figure 2:
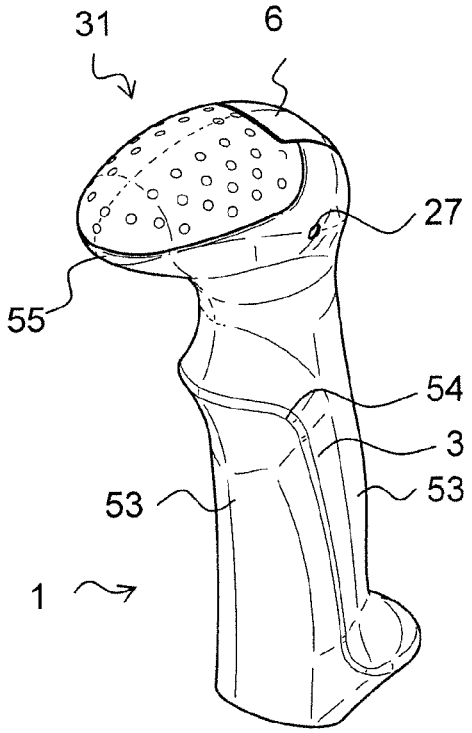
FIG. 2 shows a perspective view of a pole handle as seen obliquely from the front and from above (front side)
Figure 3:
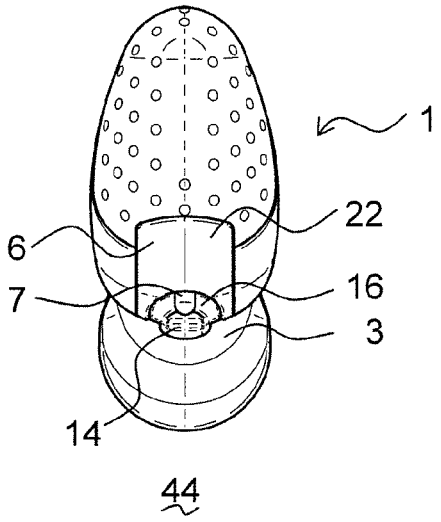
FIG. 3 shows a view of the pole handle as seen from above.
Figure 4:
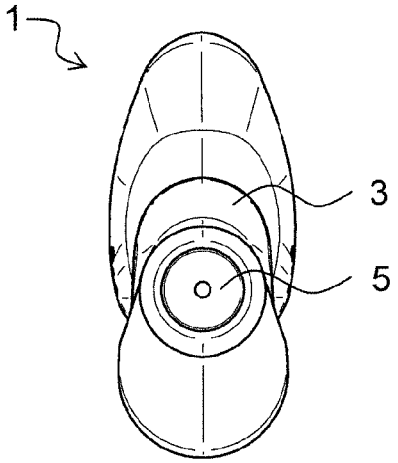
FIG. 4 shows a view of the pole handle as seen from beneath.
Figure 5:
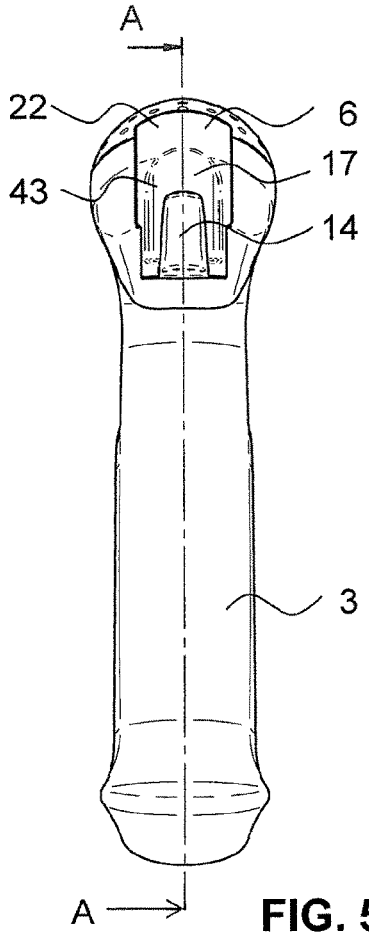
FIG. 5 shows a view of the pole handle as seen from behind.

FIG. 1 shows a side view of a pole handle as seen obliquely from behind and above, without a hand strap latched in, and FIG. 2 shows a side view of such a pole handle as seen obliquely from the front and above. FIGS. 3 and 4 show the handle from above and beneath, respectively. FIG. 5 shows the pole handle in a view from beneath.

The pole handle 1 has a front side 45, as seen in relation to the direction of travel 30, and a hand side 44.

On the underside, the pole handle 1 has a blind hole 5, the pole shaft 2 being pushed into the same and fastened therein.

The pole handle 1 has an actual handle body 3, the hand normally gripping around the lower region of the same.

A head region 31 is provided in the upper region of the pole handle 1 and has a handle nose or widened portion 32 at the front, this being rounded in the direction of the front tip 55 and widening the pole handle harmoniously toward the front.

This widened region 32 at the front can then be comfortably gripped by the user when he uses the pole for example to travel down the mountain or otherwise simply when he wants to grip the pole in the uppermost region.

Accordingly, there is also a covering element 33 in this region toward the top, said covering element having a convex outer surface 57, which is dimpled or ribbed, and having a relatively soft or non-slip surface coating 33*a* (e.g. made of thermoplastic elastomer (TPE) or EVA).

The handle body 3 consists of a hard plastic, for example of a (glass-fiber-reinforced) polyamide or PP, and to the front and rear alongside the exposed hard-plastic regions 54, as seen in the direction of travel 30, has cork inserts 53 or inserts made of thermoplastic elastomer (TPE), or EVA, for improved gripping comfort.

Figure 6:
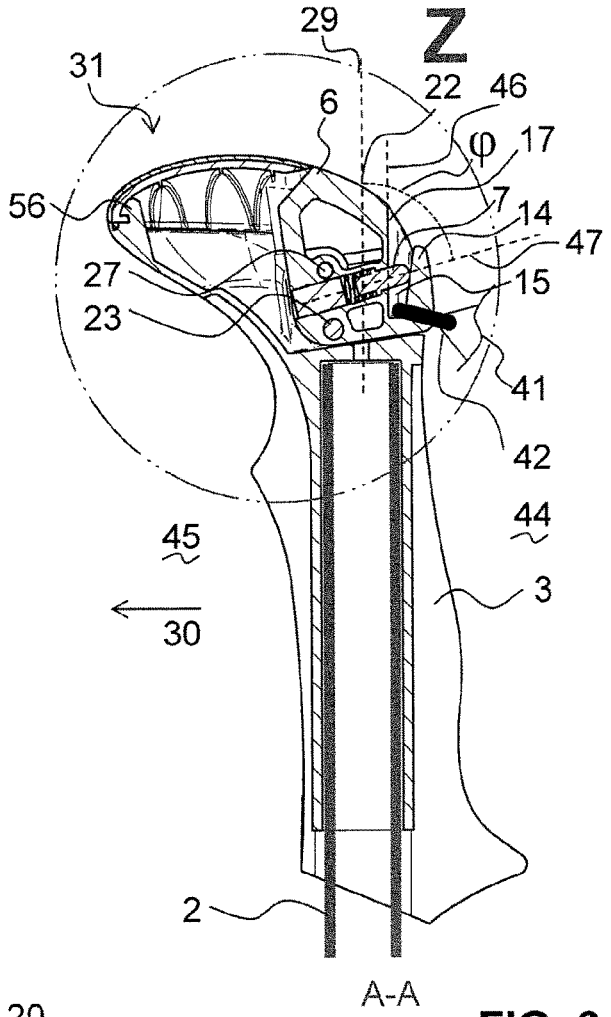
FIG. 6 shows an axial section through the pole handle parallel to the direction of travel, the section being taken along A-A in FIG. 5.

The hand strap 41 is configured here in the form of a hand strap which can be fastened on the hand and has three openings (as is known, for example, from WO 2016/037940), the hand strap 41 having a loop 42 made up of a stiff and non-extensible, tear-resistant material (e.g. braided UHMwPE such as, for example, Dyneema®) (cf. FIG. 6).

Said loop 42 allows the entire hand strap 41 to be fastened on the pole handle 1, by the loop 42 being drawn over the retaining protuberance 14.

Said retaining protuberance 14, or that region of the pole handle 1 which encloses said retaining protuberance 14, is configured such that the loop 42 latches into the retaining protuberance 14 of its own accord. This is set out in detail hereinbelow.

Figure 7:
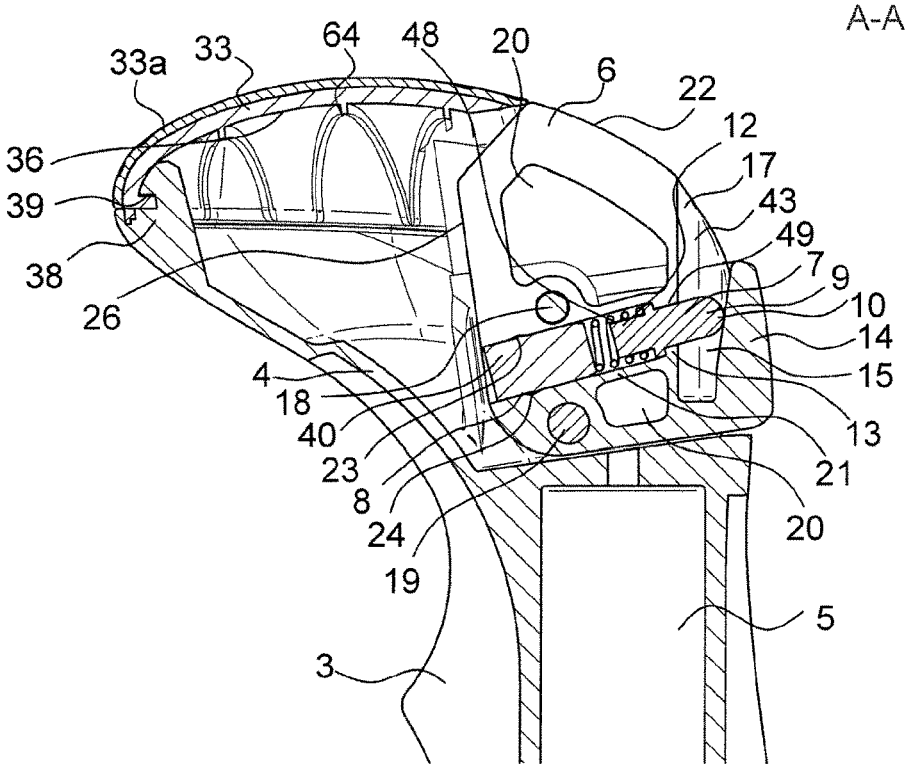
FIG. 7 shows the detail according to Z in FIG. 6.

The details of the configuration of the head region 31 of said pole handle 1 can be seen to particularly good effect in FIGS. 6 and 7. FIG. 6 shows the section taken along A-A in FIG. 5, and FIG. 7 shows the specifics of the detail Z, which is illustrated in FIG. 6.

In the hand-side region, the handle head 31 has a fastening block 6, which is incorporated in said handle head. The fastening block has a retaining protuberance 14, which is arranged to some extent in an aperture 16 of said fastening block 6.

A semicircular introduction slot 43 is located between said aperture 16 and the retaining protuberance 14, it being possible for the loop 42 to be pushed into said introduction slot in the downward direction with self-latching action. In order to facilitate this, that region of said slot 43 which is directed toward the handle head is designed in the form of a concave introduction region 17.

If the loop 42 is pulled downward with sufficient force by way of the hand strap 41, a locking pin 7 which is arranged in said slot is displaced into the interior of the handle head. This takes place counter to a spring force, and the loop 42 latches in following the restoring action of the locking pin, the loop 42 therefore then being arrested in a more or less closed region 15 beneath the tip 9 of the locking pin 7.

The design details of the fastening block 6 can best be seen with reference to FIG. 7. The latter illustrates a fastening block which has through-holes 20 in the transverse direction. However, it is also possible for the fastening block 6 to be closed at least in the central region.

Figure 8:
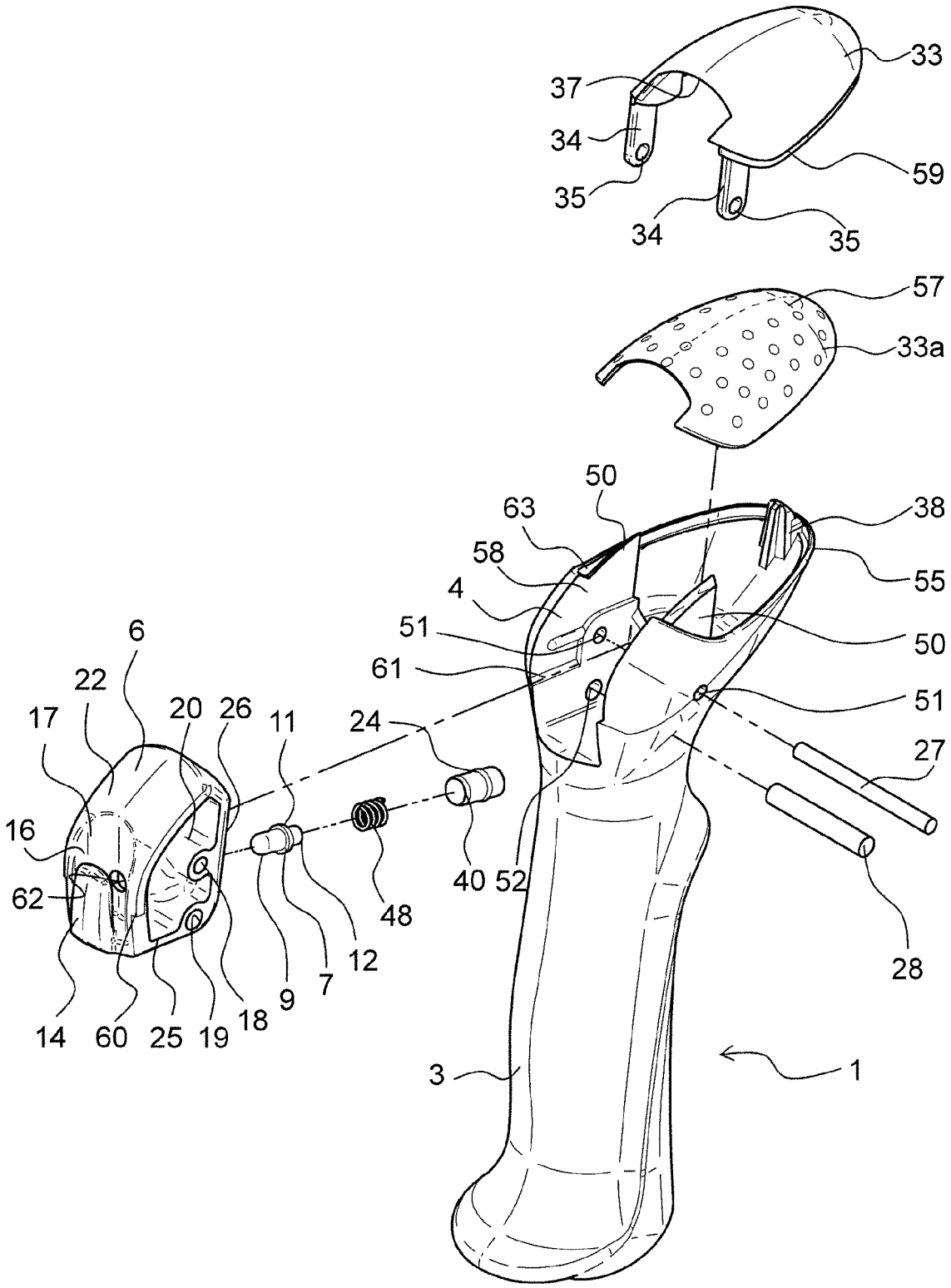
FIG. 8 shows an exploded illustration of the pole handle.

The fastening block 6 has, first of all, an upper transverse through-passage opening 18 and a lower transverse through-passage opening 19. The fastening block 6 is pushed into the aperture 4 in the handle body 3 and is then fastened in said aperture 4 using a lower transverse pin 28 and the lower transverse through-passage opening 19, wherein the pin passes, in addition, through the through-passage opening 52 in the handle (cf. FIG. 8).

An upper transverse pin 27 passes through the upper transverse through-passage opening 18 of the fastening block 6 and through the upper through-passage openings 51 in the handle body; said transverse pin also serves, at the same time, to fasten the covering element 33 on the handle head, as will be explained hereinbelow.

The fastening block 6, then, has, on one side, the aforementioned retaining protuberance 14 formed in one piece on the hand side. Said retaining protuberance is offset from the rest of the fastening block 6 via an aperture 16, an introduction slot 43 therefore being formed between the aforementioned concave introduction surface 17 and the retaining protuberance.

Relative to the pole axis 29, the introduction direction 46 is arranged essentially parallel in particular along the introduction surface 17. The main direction of the retaining protuberance 14 can be inclined to some extent in the outward direction, that is to say the introduction slot 43 can be of slightly V-shaped configuration. As can be seen in particular with reference to FIG. 7, the main direction of the retaining protuberance 14 can also be vertical and the retaining protuberance can be structured to taper upwards, this resulting in the formation of a V-shaped introduction slot 43 in a sectional illustration, as is illustrated in this figure.

On the inner surface of the introduction region 17, said inner surface being directed toward the interior of the pole handle, the body of said fastening block 6, then, contains a guide aperture 49, which also forms, to some extent, the through-opening 62 for the locking pin 7 in the fastening block 6. Said guide aperture 49 widens in the direction of the interior of the pole handle, at an encircling shoulder 13, to an aperture 8 with a somewhat greater internal diameter. Said aperture 8 then runs in the direction of the interior as far as the rear side 26 of the fastening block. The aperture 8 is therefore configured in the form of a through-passage opening through the fastening block 6. The locking pin 7 is mounted in a displaceable manner in said stepped aperture.

The locking pin 7 has a front region 9, which has its tip 10 projecting into the introduction slot 43 and delimits to some extent in the upward direction the region 15 for arresting the loops 42. The pin 7, which in this case is configured in the form of a pin made of metal, for example stainless steel, then has, adjacent to said front region 9, an encircling collar 11. The front region and said collar 11 are of circular cross section.

Said collar 11 is followed in the inward direction by a rear region 12 of the pin 7, which, in turn, has a smaller external diameter than the collar 11. The external diameter of said rear region 12 can be, for example, the same as that of the front region 9, but can also be somewhat smaller, as is illustrated here in the figures.

A helical spring 48 is arranged in the cavity between the inner wall of the aperture 8 and the outer surface of the rear region 12, said helical spring being braced against a closure peg 40, which is pushed into the aperture 8 from the rear side 26 and fastened thereon. The helical spring 48 is therefore located between an inner surface of the closure peg 40 and the encircling collar 11 and thus forces the pin 7 in the direction of the retaining protuberance 14. The stop for the pin 7 can be formed by the shoulder 13; however, it is also possible for the stop to be formed by the tip 10 of the locking pin coming into contact with the retaining protuberance. The closure peg has an encircling rib 24, which engages in a corresponding encircling groove 23 in the opening 8. It is thus possible, once the pin 7 and the helical spring 48 have been pushed into the fastening block 6 from the rear, for the closure peg 40 to be pushed in straightforwardly, and with largely self-latching action, and fastened in the fastening block 6. In addition, or as an alternative, adhesive bonding can also be provided.

The tip 10 of the locking pin 7 is designed here in the form of a convex hemisphere. The helical spring 48 therefore braces the displaceable position of the locking pin 7 in the direction of the retaining protuberance 14.

The important factor in relation to such a design, then, is, inter alia, the fact that the displacement direction 47 of the locking pin 7 in the direction of the retaining protuberance 14 encloses an angle φ of less than 90 degrees with the upwardly directed pole axis 29. In other words, the locking pin 7 is slightly inclined to some extent upward in the introduction slot 43, which results in the introduction force for the loop 42 being considerably smaller (typically approximately 60N) than that required for removing the loop 42 (force typically approximately 80N) from the region 15.

The angle φ is typically in the region of 85 degrees, which, in the same way, results in the introduction force for self-latching action being considerably lower than the release force. This is advantageous because it should be easier for the user to latch the loop in, this operation being assisted by it being inherently easier to subject the hand strap to a downwardly directed force. For the purpose of removing the hand strap from the pole, a greater force in the upward direction should be necessary, in order to avoid unintended separation of the hand strap from the pole handle. Nevertheless, the corresponding design is very straightforward and reliable, to be precise irrespective of temperature, moisture and, in particular, icing up, for example in the case of (cross-country) skiing.

In addition, the system proposed here is advantageously of modular design. In other words, there is a fastening block 6, which is fastened in an immovable manner on the pole handle, to be precise via the already mentioned transverse pins 27 and 28. The modular construction can best be seen with reference to FIG. 8, an exploded illustration. The aperture 4 in the handle body 3 is of elongate design as it were in the direction of travel and is drawn further downward on the handle side. Therefore, to some extent, the handle body 3 forms only the two side walls 58 in the head region, with an aperture 4 being provided therebetween for the insert parts.

The critical insert part here is the fastening block 6, which has already been mentioned above. Said fastening block is formed, as far as possible, from a stiff plastic and has transverse apertures 20, in locations where there is no need for material for the structural functions. A guide cylinder 21 is provided for guiding the locking pin 7.

Said fastening block 6 can be pushed into the aperture 4 from above between corresponding lateral wall regions 58, wherein guide steps 60 and corresponding mating surfaces 61 in the aperture ensure precise positioning of the block in the handle head.

Then, the lower transverse pin 28 can be pushed in laterally and the fastening block 6 can thus be fixed in the handle body.

In a next step, the upper cap 33 is introduced. On the one hand, the cap 33 has an incision 37 on the hand side; the upper region of the fastening block 6 ends up located in said incision. On the other hand, the covering cap 33, alongside an accurate-fit guide step 59, has two downwardly directed strip-form fastening arms 34, at the lower end of which a transversely running fastening opening 35 is arranged. Outside two partition walls 50 of the handle body, the fastening block 6 being located between said partition walls 50, said fastening arms 34 are pushed into the handle body in the downward direction through the slot 63, until the fastening openings 35 are aligned coaxially in relation to the corresponding through-passage openings 51. When the fastening block 6 has been inserted correctly, the through-passage openings 51 are in any case already aligned in relation to the upper through-passage openings 18 of the fastening block 6.

In order to ensure the fastening of the covering cap 33, which has a concave inner region 36, provided with ribs 64, and has an inner transverse rib 39, arranged at the front tip, the handle head has, at the front tip, a front fastening nose 38 with a locking nose 56. The front tip of the covering cap 33 can then be clicked over the nose 38 and latched in there. Then, the upper transverse pin 27 can be pushed through the openings 51, 35 and 18, and the fastening block 6, and in the same way the covering cap 33, can thus be fastened definitively in the handle head.

LIST OF REFERENCE SIGNS

| | |
|---|---|
| 1 | Pole handle |
| 2 | Pole shaft |
| 3 | Handle body |
| 4 | Aperture in 3 |
| 5 | Cavity in 3 for pole shaft |
| 6 | Fastening block |
| 7 | Locking pin |
| 8 | Aperture in 6 for 7 |
| 9 | Front region of 7 |
| 10 | Rounded tip of 7 |
| 11 | Encircling collar of 7 |
| 12 | Rear region of 7 |
| 13 | Encircling shoulder of 8 |
| 14 | Retaining protuberance |
| 15 | Region for fastened loop/eyelet |
| 16 | Aperture in 6 for 14 |
| 17 | Concave introduction region in 6 |
| 18 | Upper transverse through-passage opening in 6 |
| 19 | Lower transverse through-passage opening in 6 |
| 20 | Through-holes or blind holes in 6 |
| 21 | Guide cylinder for 7 |
| 22 | Upper outer region of 6 |
| 23 | Latching groove in 8 for 24 of 40 |
| 24 | Latching protrusion of 40 |
| 25 | Side wall of 6 |
| 26 | Rear side of 6 |
| 27 | Upper transverse pin |
| 28 | Lower transverse pin |
| 29 | Pole axis |
| 30 | Direction of travel |
| 31 | Head region of 1 |
| 32 | Widened portion at the front of 1 in the head region |
| 33 | Covering element of 1 |
| 33a | Elastomeric layer element of 33 |
| 34 | Fastening arms of 33 |
| 35 | Fastening openings for 34 using 27 |
| 36 | Concave inner region of 33 |
| 37 | Incision in 33 for 6 |

-continued

LIST OF REFERENCE SIGNS

| | |
|---|---|
| 38 | Front fastening element on 3 for 33 |
| 39 | Transverse rib or transverse crosspiece on 33 for 38 |
| 40 | Closure peg |
| 41 | Hand strap |
| 42 | Loop |
| 43 | Introduction slot |
| 44 | Hand side |
| 45 | Front side |
| 46 | Introduction direction |
| 47 | Displacement direction of 7 |
| 48 | Helical spring |
| 49 | Guide aperture |
| 50 | Partition walls/guide walls |
| 51 | Through-passage opening for 27 in 3 |
| 52 | Through-passage opening for 28 in 3 |
| 53 | Handle elements of gripping region of 3 (e.g. made of cork or elastomer) |
| 54 | Exposed hard-plastic regions of 3 |
| 55 | Front tip of 31 |
| 56 | Locking nose of 38 |
| 57 | Convex outer region of 33 |
| 58 | Lateral wall regions of 3, which delimit the aperture 4 laterally |
| 59 | Guide step in 33 |
| 60 | Guide step on side wall of 6 |
| 61 | Guide step on side wall 58 |
| 62 | Through-opening for 7 in 6 |
| 63 | Slot for 34 between 50 and 58 |
| 64 | Rib struts |
| φ | Angle between displacement direction 47 in relation to 14 and pole-axis direction upward |

The invention claimed is:

1. A pole handle, having a handle body and having a hook-like device for fastening a hand-retaining device, wherein displaceable latch-in means are arranged in the region of the hook-like device such that a loop-form, ring-form or eyelet-form device, which is provided on the hand-retaining device and is pushed into the hook-like device essentially from above, is fixed in the hook-like device with self-latching action, wherein the hook-like device is arranged in the upper region of the pole handle, on the hand side, wherein the hook-like device comprises a retaining protuberance or retaining pin, which is offset from the handle body in the direction of the hand side, an upwardly open introduction slot being formed in the process, or is arranged in the form of an incision in the handle body, wherein the latch-in means are designed in the form of a restraining nose, which, in the braced position, defines in the downward direction a region for the loop-form, ring-form or eyelet-form device, said region being confined counter to a force, and wherein the pole handle does not have any means which can displace or free the latch-in means such that a loop-form, ring-form or eyelet-form device pushed into the hook-like device can be removed from the confined region in a force-free manner or counter to a relatively low force, the hand-retaining device being separated from the pole handle in the process wherein the latch-in means are designed in the form of a locking pin which can be displaced along a displacement direction counter to a restoring force, and wherein the locking pin is braced against the retaining protuberance and/or against an inner stop in the handle body, and a front region of the locking pin projects into the introduction slot, or the incision, and delimits the confined region in the upward direction, and a rear region in the handle body is mounted in a displaceable manner in an aperture wherein, at least in the front region, the locking pin has a diameter ranging from 1-8 mm and wherein a separate fastening block with the retaining protuberance, locking pin and guide for the locking pin, is fastened in an immovable manner in an aperture of the handle body.

2. The pole handle as claimed in claim 1, wherein the restoring force is ensured by a spring, provided in the aperture.

3. The pole handle as claimed in claim 1, wherein the pole handle extends along a pole axis, wherein the introduction slot, or the incision, defines an introduction direction, which runs essentially parallel to the pole axis, and wherein a displacement direction of the locking pin in relation to the retaining protuberance encloses an angle of less than 90° with the upwardly directed pole-axis direction.

4. The pole handle as claimed in claim 3, wherein the angle ranges from 60-85°.

5. The pole handle as claimed in claim 3, wherein the angle ranges from 70-80° or ranges from 72-77°.

6. The pole handle as claimed in claim 1, wherein the force by which the loop-form, ring-form or eyelet-form device can be fastened on the pole handle is smaller or greater than the force which is necessary to release the loop-form, ring-form or eyelet-form device from the pole handle.

7. The pole handle as claimed in claim 1, wherein the tip of the locking pin, said tip being directed toward the retaining protuberance, has a dome-shaped or hemispherical rounding.

8. The pole handle as claimed in claim 1, wherein the locking pin mounted in a displaceable manner, in the form of a cylindrical pin, in the handle body such that, in the region adjacent to the introduction slot, or incision, the front region is guided in a cylindrical guide aperture which widens in the direction of the interior of the handle body, a step being formed in relation to the aforementioned aperture in the process.

9. The pole handle as claimed in claim 1, wherein the fastening block has a through-passage opening for the locking pin, said through-passage opening being closed on the rear side of the fastening block via a closure peg.

10. The pole handle as claimed in claim 1, wherein the fastening block has two through-passage openings running transversely to the pole axis, and is fastened in the aperture in the handle body using corresponding transverse pins, wherein at least one of the transverse pins serves, in addition, to fasten a covering cap, which delimits the handle head at least to some extent in the upward direction.

11. The pole handle as claimed in claim 1, wherein the pole handle has a lower handle-body region, the latter forming a lower gripping region of the pole handle and having an aperture for a pole shaft at the lower end, and also has a head region, wherein the head region has a widened portion at the front, said widened portion merging essentially smoothly, in the front pole-handle region, into the upper gripping region, wherein, in the front pole-handle region, the widened portion is formed with an overhang, which projects beyond the gripping region as seen in the direction of travel, and wherein the overhang is more than 50% of an average extent of the gripping region in the direction of travel, and a section plane of the head region which is defined by a foremost tip of the widened portion and by a transverse axis of the head region which is arranged transversely to the longitudinal axis of the pole and transversely to the direction of travel, and is arranged where the head region is widest, as measured transversely to the direction of travel and transversely to the longitudinal axis of the pole, is angled from the longitudinal axis of the pole by an obtuse angle ranging from 90-135 degrees.

12. A pole, comprising:

a pole handle as claimed in claim 1, a pole shaft, which is in one piece or, for adjustment in accordance with requirements, in more than one piece, and a pole tip, alone or in combination with a hand-retaining, with a loop-form, ring-form or eyelet-form device, which is provided on the hand-retaining device.

13. The pole according to claim 12 in the form of a walking stick, trekking pole, ski pole, cross-country ski pole or Nordic walking pole.

14. The pole handle according to claim 1 for walking sticks, trekking poles, ski poles, cross-country ski poles and Nordic walking poles.

15. The pole handle according to claim 1, wherein said hand-retaining device is in the form of a hand strap or of a glove.

16. The pole handle as claimed in claim 1, wherein the restoring force is ensured by a helical spring, provided in the aperture, wherein the helical spring engages at least to some extent around an end portion of the locking pin which is directed toward the pole handle.

17. The pole handle as claimed in claim 1, wherein the tip of the locking pin, said tip being directed toward the retaining protuberance, has a dome-shaped or hemispherical rounding, and wherein the tip, in the rest state, is in contact with the retaining protuberance or is spaced apart from the retaining protuberance by no more than 1 mm, or no more than 0.5 mm or 0.2 mm.

18. The pole handle as claimed in claim 1, wherein, in the front region and in the rear region, the locking pin has a diameter ranging from 2-6 mm, or ranging from 3-5 mm.

19. The pole handle as claimed in claim 1, wherein the fastening block has a through-passage opening for the locking pin, said through-passage opening being closed on the rear side of the fastening block via a closure peg, made of plastic or metal, and/or wherein the fastening block has a guide cylinder for the locking pin and also at least one through-hole, or blind-hole openings, running transversely to the direction of travel.

20. The pole handle as claimed in claim 1, wherein the fastening block has two through-passage openings running transversely to the pole axis, and is fastened in the aperture in the handle body using corresponding transverse pins, wherein the transverse pin arranged further upward in the direction of the handle head, serves, in addition, to fasten a covering cap, which delimits the handle head at least to some extent in the upward direction, the covering cap having fastening arms with through-passage openings for the corresponding transverse pin, and wherein, from at least in the outwardly exposed region, the covering cap can be provided with a non-slip and/or soft coating or consists of a corresponding non-slip and/or soft material.

21. A method for assembling a pole handle having a handle body and having a hook-like device for fastening a hand-retaining device, wherein displaceable latch-in means are arranged in the region of the hook-like device such that a loop-form, ring-form or eyelet-form device, which is provided on the hand-retaining device and is pushed into the hook-like device essentially from above, is fixed in the hook-like device with self-latching action, wherein the hook-like device is arranged in the upper region of the pole handle, on the hand side, wherein the hook-like device comprises a retaining protuberance or retaining pin, which is offset from the handle body in the direction of the hand side, an upwardly open introduction slot being formed in the process, or is arranged in the form of an incision in the handle body, wherein the latch-in means are designed in the form of a restraining nose, which, in the braced position, defines in the downward direction a region for the loop-form, ring-form or eyelet-form device, said region being confined counter to a force, and wherein the pole handle does not have any means which can displace or free the latch-in means such that a loop-form, ring-form or eyelet-form device pushed into the hook-like device can be removed from the confined region in a force-free manner or counter to a relatively low force, the hand-retaining device being separated from the pole handle in the process wherein the latch-in means are designed in the form of a locking pin which can be displaced along a displacement direction counter to a restoring force, and wherein the locking pin is braced against the retaining protuberance and/or against an inner stop in the handle body, and a front region of the locking pin projects into the introduction slot, or the incision, and delimits the confined region in the upward direction, and a rear region in the handle body is mounted in a displaceable manner in an aperture and wherein a separate fastening block with the retaining protuberance, locking pin and guide for the locking pin, is fastened in an immovable manner in an aperture of the handle body wherein in said method the locking pin is pushed into the fastening block, from a rear side of the latter, into the aperture and also a spring is pushed in, together or one after the other, and the aperture is closed on the rear side by a closure peg, then the fastening block is inserted into the aperture of the handle body of the pole handle, then a covering cap is inserted, essentially closing off the definitive surface of the handle body in the process, and then transverse pins are used to fasten the fastening block and covering cap, provided that one of the transverse pins can also be inserted prior to the covering cap being fitted.

22. The method according to claim 21, wherein the locking pin is pushed into the fastening block, from the rear side of the latter, into the aperture and into the guide aperture and also a helical spring is pushed in, together or one after the other, and the aperture is closed on the rear side by a closure peg, then the fastening block is inserted into the aperture in the handle body of the pole handle, then the covering cap is inserted, essentially closing off the definitive surface of the handle body in the process, and is latched in the front-tip region, and then transverse pins are used to fasten the fastening block and covering cap, provided that one of the transverse pins can also be inserted prior to the covering cap being fitted.

23. A pole handle, having a handle body and having a hook-like device for fastening a hand-retaining device, wherein displaceable latch-in means are arranged in the region of the hook-like device such that a loop-form, ring-form or eyelet-form device, which is provided on the hand-retaining device and is pushed into the hook-like device essentially from above, is fixed in the hook-like device with self-latching action, wherein the hook-like device is arranged in the upper region of the pole handle, on the hand side, wherein the hook-like device comprises a retaining protuberance or retaining pin, which is offset from the handle body in the direction of the hand side, an upwardly open introduction slot being formed in the process, or is arranged in the form of an incision in the handle body, wherein the latch-in means are designed in the form of a restraining nose, which, in the braced position, defines in the downward direction a region for the loop-form, ring-form or eyelet-form device, said region being confined counter to a force, and wherein the pole handle does not have any means which can displace or free the latch-in means such that a loop-form, ring-form or eyelet-form device pushed into the hook-like device can be removed from the confined region in a force-free manner or counter to a relatively low force, the hand-retaining device being separated from the pole handle in the process wherein the latch-in means are designed in the form of a locking pin which can be displaced along a displacement direction counter to a restoring force, and wherein the locking pin is braced against the retaining protuberance and/or against an inner stop in the handle body, and a front region of the locking pin projects into the introduction slot, or the incision, and delimits the confined region in the upward direction, and a rear region in the handle body is mounted in a displaceable manner in an aperture wherein the locking pin, consisting of metal or a glass-fiber-reinforced high-strength plastic, including polyamide, is mounted in a displaceable manner, in the form of a cylindrical pin, in the handle body such that, in the region adjacent to the introduction slot, or incision, the front region is guided in a cylindrical guide aperture which widens in the direction of the interior of the handle body, a step being formed in relation to the aforementioned aperture in the process, and wherein, adjacent to the front region on the inside, the locking pin has an encircling collar, of which the outer radius essentially corresponds to the inner radius of the aforementioned aperture or is smaller than the same, but greater than the radius of the guide aperture, and wherein the rear region of the locking pin follows said collar and has a smaller outer radius than the collar, the same outer radius as the front region of the locking pin, and wherein a helical spring surrounds said rear region and butts against the collar.

24. The pole handle as claimed in claim 23, wherein, at least in the front region, the locking pin has a diameter ranging from 1-8 mm.

25. A pole handle, having a handle body and having a hook-like device for fastening a hand-retaining device, wherein displaceable latch-in means are arranged in the region of the hook-like device such that a loop-form, ring-form or eyelet-form device, which is provided on the hand-retaining device and is pushed into the hook-like device essentially from above, is fixed in the hook-like device with self-latching action, wherein the hook-like device is arranged in the upper region of the pole handle, on the hand side, wherein the hook-like device comprises a retaining protuberance or retaining pin, which is offset from the handle body in the direction of the hand side, an upwardly open introduction slot being formed in the process, or is arranged in the form of an incision in the handle body, wherein the latch-in means are designed in the form of a restraining nose, which, in the braced position, defines in the downward direction a region for the loop-form, ring-form or eyelet-form device, said region being confined counter to a force, and wherein the pole handle does not have any means which can displace or free the latch-in means such that a loop-form, ring-form or eyelet-form device pushed into the hook-like device can be removed from the confined region in a force-free manner or counter to a relatively low force, the hand-retaining device being separated from the pole handle in the process wherein the latch-in means are designed in the form of a locking pin which can be displaced along a displacement direction counter to a restoring force, and wherein the locking pin is braced against the retaining protuberance and/or against an inner stop in the handle body, and a front region of the locking pin projects into the introduction slot, or the incision, and delimits the confined region in the upward direction, and a rear region in the handle body is mounted in a displaceable manner in an aperture wherein, at least in the front region, the locking pin has a diameter ranging from 1-8 mm wherein a separate fastening block with the retaining protuberance, locking pin and guide for the locking pin, is fastened in an immovable manner in an aperture of the handle body, which aperture is configured in the form of an aperture which runs in the direction of travel, and therefore the head region is formed laterally by the handle body, wherein said fastening block is fastened in the handle body via at least one, or two, transverse pin(s).

26. A pole handle, having a handle body and having a hook-like device for fastening a hand-retaining device, wherein displaceable latch-in means are arranged in the region of the hook-like device such that a loop-form, ring-form or eyelet-form device, which is provided on the hand-retaining device and is pushed into the hook-like device essentially from above, is fixed in the hook-like device with self-latching action, wherein the hook-like device is arranged in the upper region of the pole handle, on the hand side, wherein the hook-like device comprises a retaining protuberance or retaining pin, which is offset from the handle body in the direction of the hand side, an upwardly open introduction slot being formed in the process, or is arranged in the form of an incision in the handle body, wherein the latch-in means are designed in the form of a restraining nose, which, in the braced position, defines in the downward direction a region for the loop-form, ring-form or eyelet-form device, said region being confined counter to a force, and wherein the pole handle does not have any means which can displace or free the latch-in means such that a loop-form, ring-form or eyelet-form device pushed into the hook-like device can be removed from the confined region in a force-free manner or counter to a relatively low force, the hand-retaining device being separated from the pole handle in the process wherein the pole handle has a lower handle-body region, the latter forming a lower gripping region of the pole handle and having an aperture for a pole shaft at the lower end, and also has a head region, wherein the head region has a widened portion at the front, said widened portion merging essentially smoothly, in the front pole-handle region, into the upper gripping region, wherein, in the front pole-handle region, the widened portion is formed with an overhang, which projects beyond the gripping region as seen in the direction of travel, wherein the overhang is more than 50% of an average extent of the gripping region in the direction of travel, and a section plane of the head region which is defined by a foremost tip of the widened portion and by a transverse axis of the head region which is arranged transversely to the longitudinal axis of the pole and transversely to the direction of travel, and is arranged where the head region is widest, as measured transversely to the direction of travel and transversely to the longitudinal axis of the pole, is angled from the longitudinal axis of the pole by an obtuse angle ranging from 90-135 degrees, and wherein, in said section plane, the head region has a rounded contour, of which the front portion, as seen in the direction of travel, is defined essentially by an arc of a first circle and the rear portion, as seen counter to the direction of travel, is defined essentially by an arc of a second circle, the center point of said first and second circles being offset in relation to one another by an amount of 0.5-6 cm along the direction of travel, wherein the radius of curvature of the first circle is smaller than the radius of curvature of the second circle in the rear pole-handle region.

27. The pole handle as claimed in claim 26, wherein, at least in the front region, the locking pin has a diameter ranging from 1-8 mm.

* * * * *